US011408218B2

(12) United States Patent
Iijima et al.

(10) Patent No.: US 11,408,218 B2
(45) Date of Patent: Aug. 9, 2022

(54) SLIDING DOOR DEVICE

(71) Applicant: SUGATSUNE KOGYO CO., LTD., Tokyo (JP)

(72) Inventors: Tadashi Iijima, Tokyo (JP); Kyosuke Uchino, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/560,271

(22) Filed: Sep. 4, 2019

(65) Prior Publication Data

US 2020/0080358 A1 Mar. 12, 2020

(30) Foreign Application Priority Data

Sep. 7, 2018 (JP) ..... JP2018-168200

(51) Int. Cl.
*E05F 1/16* (2006.01)
*E05D 15/06* (2006.01)
*E05F 5/00* (2017.01)

(52) U.S. Cl.
CPC ..... *E05F 1/16* (2013.01); *E05D 15/0626* (2013.01); *E05F 5/003* (2013.01); *E05Y 2800/24* (2013.01)

(58) Field of Classification Search
CPC ... E05F 1/16; E05F 5/003; E05F 3/227; E05F 5/108; E05F 3/00; E05F 3/02; E05F 3/04; E05F 3/18; E05D 15/0626; Y10T 16/27; Y10T 16/56; Y10T 16/61; Y10T 16/593; Y10T 16/276; Y10T 16/281; E05Y 2800/24; E05Y 2201/64
See application file for complete search history.

(56) References Cited

U.S. PATENT DOCUMENTS

| | | | | |
|---|---|---|---|---|
| 7,028,370 | B2 * | 4/2006 | Hoshide | A47B 88/467 16/96 R |
| 7,210,198 | B2 * | 5/2007 | Hoshide | E05F 5/003 16/96 R |
| 7,481,505 | B2 * | 1/2009 | Orita | E05F 1/16 312/333 |
| 9,879,459 | B2 * | 1/2018 | Zimmer | E05F 3/10 |
| 10,151,130 | B2 * | 12/2018 | Wang | E05F 5/003 |
| 10,221,604 | B2 * | 3/2019 | Zimmer | E05F 1/16 |
| 10,724,285 | B2 * | 7/2020 | Dodge | E05F 3/224 |
| 10,822,863 | B2 * | 11/2020 | Bernhagen | E06B 7/16 |
| 2020/0190882 | A1 * | 6/2020 | Bantle | E05F 5/003 |

FOREIGN PATENT DOCUMENTS

JP 2011-214343 A 10/2011

* cited by examiner

*Primary Examiner* — Victor D Batson
*Assistant Examiner* — Matthew J Sullivan
(74) *Attorney, Agent, or Firm* — Masuvalley & Partners; Peter R. Martinez

(57) ABSTRACT

Provided is a sliding door device which is capable of retracting a sliding door diagonally. Such a sliding door device 1 includes rails 7*a* and 7*b* for guiding the sliding door 2 to move in a retracting direction A from an open position to a closed position with respect to a main body 3 and guiding the sliding door 2 to move forward or backward in a front view of the sliding door 2 until reaching the closed position, a rod-shaped trigger 8 provided on one of the main body 3 and the sliding door 2, and a retracting device 9' provided on the other of the main body 3 and the sliding door 2 and retracting the trigger 8 while sliding in an axial direction D of the trigger 8 so that the sliding door 2 can move forward or backward.

4 Claims, 11 Drawing Sheets

SLIDING DOOR DEVICE

RELATED APPLICATIONS

This application claims priority under 35 U.S.C. § 119 from Japanese Patent Application No. 2018-168200, filed Sep. 7, 2018, entitled "Sliding Door Device", which is incorporated herein by reference in its entirety.

TECHNICAL FIELD

The present invention relates to a sliding door device provided with a retracting device and adapted to move a sliding door to a closed position.

BACKGROUND ART

A sliding door device which is provided with a retracting device and is adapted to move a sliding door to a closed position is known (see, for example, patent document 1:JP2011-214343A). This sliding door device includes rails, a trigger and the retracting device. The rails are attached to a main body and guides that the sliding door moves in a retracting direction from an open position to the closed position. The trigger is attached to any one of the main body and the sliding door. The retracting device is attached to the other of the main body and the sliding door. The retracting device retracts the trigger, so that the sliding door moves to the closed position.

SUMMARY OF THE INVENTION

By the way, in the sliding door, there is a sliding door which moves forward or backward in a front view of the sliding door until reaching the closed position. If this sliding door is used, for example, since the sliding door and a wall surface can be made flat in the closed position of the sliding door, the appearance can be improved. It is desirable that this sliding door also have a retracting function.

However, in the conventional sliding door device, although the sliding door can be retracted in straight in the retracting direction, the sliding door moving forward or backward cannot be retracted diagonally in the front view of the sliding door. This is because the engagement between the retracting device and the trigger are released when the sliding door moves forward or backward.

Therefore, an object of this invention is to provide a sliding door device which is capable of retracting the sliding door diagonally.

In order to solve the above problems, one embodiment of the present invention is a sliding door device comprising: rails for guiding a sliding door to move in a retracting direction from an open position to a closed position with respect to a main body, and guiding the sliding door to move forward or backward in a front view of the sliding door until reaching the closed position; a rod-shaped trigger provided on one of the main body and the sliding door; and a retracting device provided on the other of the main body and the sliding door, and retracting the trigger while sliding in an axial direction so that the sliding door can move forward or backward.

According to the present invention, since the retracting device retracts the rod-shaped trigger while sliding in an axial direction of the rod-shaped trigger, the sliding door can be retracted diagonally.

BRIEF DESCRIPTION OF THE DRAWINGS

(FIG. 3A is a perspective view as viewed from the lower side and FIG. 3B is a side view).

(FIG. 4A shows when a catcher is in a standby position and FIG. 4B shows when the catcher is in a retracted position).

(FIG. 6A is a perspective view of the trigger as viewed from an upper side and FIG. 6B is a side view of the trigger).

(FIG. 7A shows a back view of the sliding door device and FIG. 7B shows a bottom view of the sliding door device).

(FIG. 8A shows a back view of the sliding door device and FIG. 8B shows a bottom view of the sliding door device).

(FIG. 9A shows a back view of the sliding door device and FIG. 9B shows a bottom view of the sliding door device).

(FIG. 11A is a side view and FIG. 11B is a bottom view).

Hereinafter, the sliding door device of the embodiment of the present invention will be described based on the attached drawings. However, the sliding door device of the present invention can be embodied in various embodiments, and is not limited to the embodiments described herein. This embodiment is provided with the intention to enable a person skilled in the art to fully understand the scope of the invention by making the disclosure of the specification sufficient.

FIRST EMBODIMENT

Figure 1:
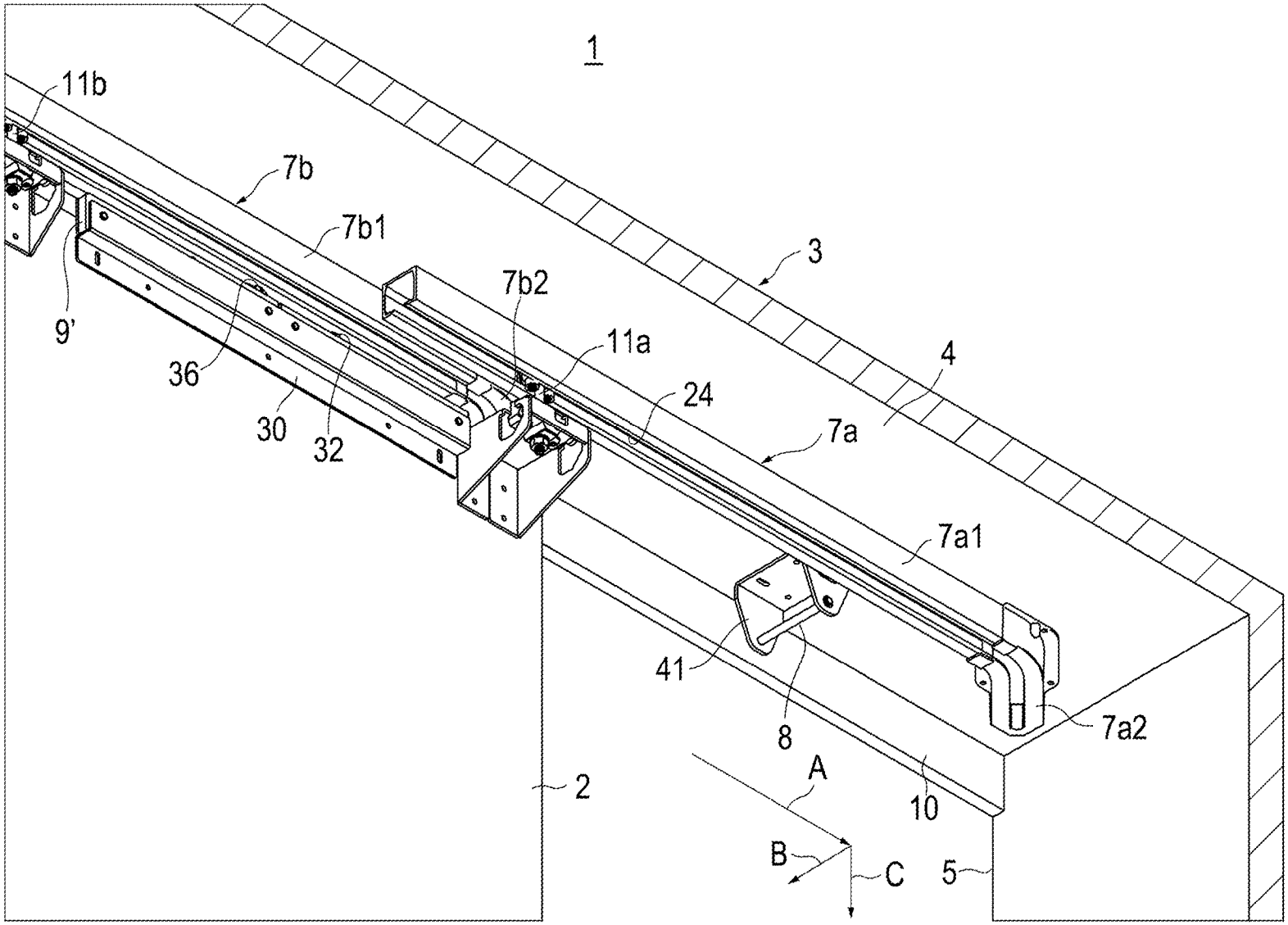
FIG. 1 is a perspective view of a sliding door device (when a sliding door is in an open position) of a first embodiment of present invention as viewed from a lower side.
Figure 2:
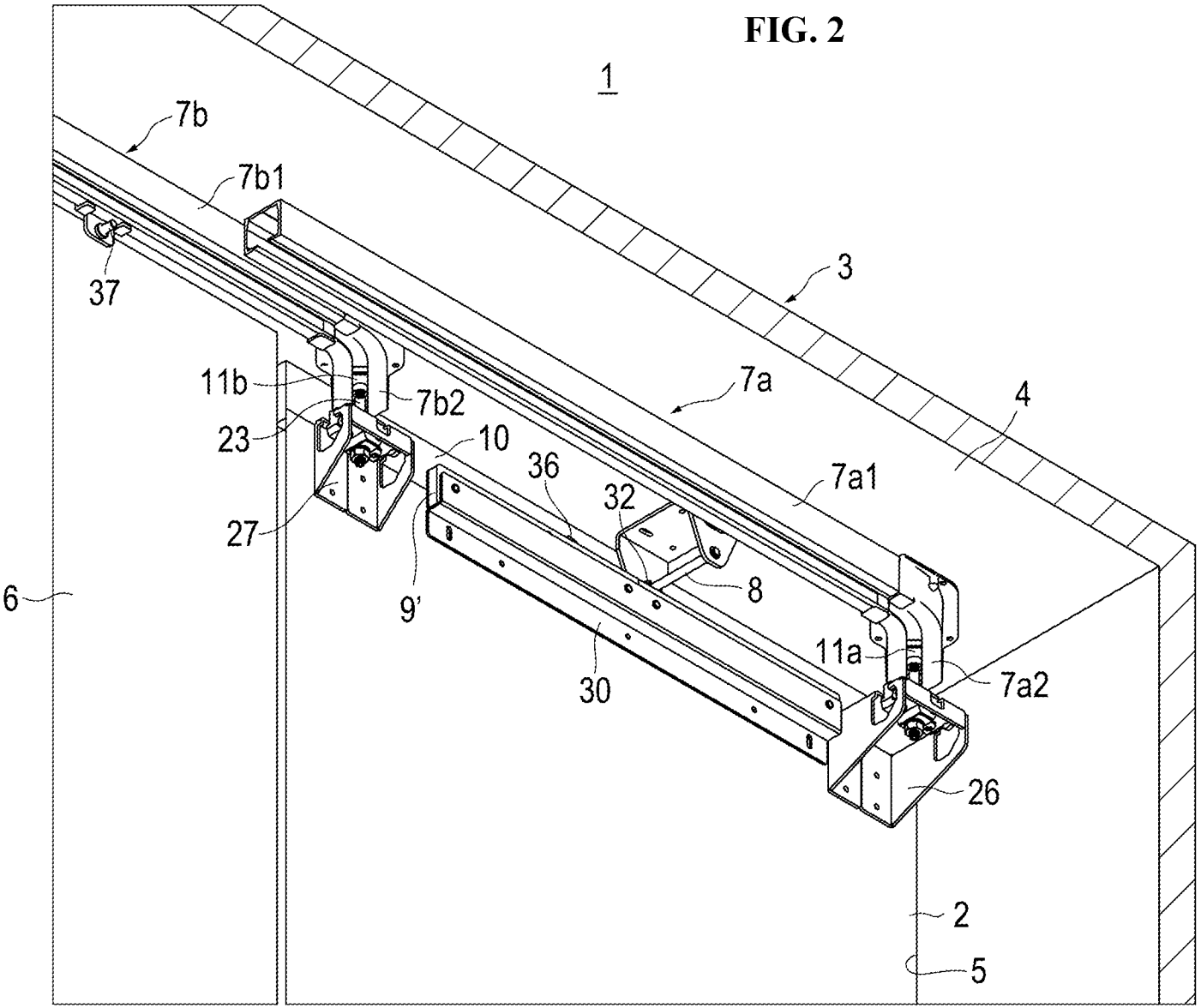
FIG. 2 is a perspective view of the sliding door device (when the sliding door is in a closed position) of the present embodiment as viewed from the lower side.

Each of FIGS. 1 and 2 is the perspective view of the sliding door device 1 of the first embodiment of the present invention as viewed from the lower side. FIG. 1 shows an open position of the sliding door 2 and FIG. 2 shows a closed position of the sliding door 2. 2 is the sliding door, 3 is a main body, 4 is an upper frame of the main body, 5 is an opening of the main body, and 6 is a wall of the main body.

The sliding door device 1 includes rails 7*a* and 7*b*, a trigger 8 and a retracting device 9'. The rails 7*a* and 7*b* are attached to the main body 3. The trigger 8 is attached to the main body 3. The retracting device 9' is attached to the sliding door 2. The trigger 8 and the retracting device 9' are arranged outside the rails 7*a* and 7*b*. On a lower surface of the upper frame 4 of the opening 5 of the main body 3, provided is a blind plate 10 for hiding the rails 7*a* and 7*b*, the trigger 8 and the retracting device 9'.

The rails 7*a* and 7*b* are attached to the lower surface of the upper frame 4. The rails 7*a* and 7*b* guides that the sliding door 2 moves in a retracting direction A (see FIG. 1) from the open position to the closed position with respect to the main body 3, and guides that the sliding door 2 moves forward B (see FIG. 1) in a front view of the sliding door 2 until reaching the closed position. Here, the front view means that the sliding door 2 is viewed from a front side. FIG. 1 and FIG. 2 show the perspective views when the sliding door 2 is seen from a back side.

The rails 7*a* and 7*b* are provided with a door tip rail 7*a* disposed on a door tip side and a door tail rail 7*b* disposed on a door tail side. The door tip rail 7*a* includes a straight rail 7*a*1 and an inclined rail 7*a*2 which is connected to an end of the straight rail 7*a*1 and bent with respect to the straight rail 7*a*1. The door tail rail 7*b* also includes a straight rail 7*b*1 and an inclined rail 7*b*2 which is connected to an end of the straight rail 7*b*1 and bent with respect to the straight rail 7*b*1. The straight rail 7*a*1 and the straight rail 7*b*1 are parallel to each other. The inclined rail 7*a*2 and the inclined rail 7*b*2 are parallel to each other.

A door roller for door tip 11*a* runs in the door tip rail 7*a*. A door roller for door tail 11*b* runs in the door tail rail 7*b*. When the door roller for door tip 11*a* and the door roller for door tail 11*b* run in the straight rails 7*a*1 and 7*b*1, the sliding door 2 linearly moves in the retracting direction A. When the door roller for door tip 11*a* and the door roller for door tail 11*b* run in the inclined rails 7*a*2 and 7*b*2, the sliding door 2 moves obliquely in parallel in a direction C inclined with respect to the retracting direction A and forward B. Since the inclined rail 7*a*2 and the inclined rail 7*b*2 are parallel to each other, the sliding door 2 moves obliquely in parallel.

Figure 3A:
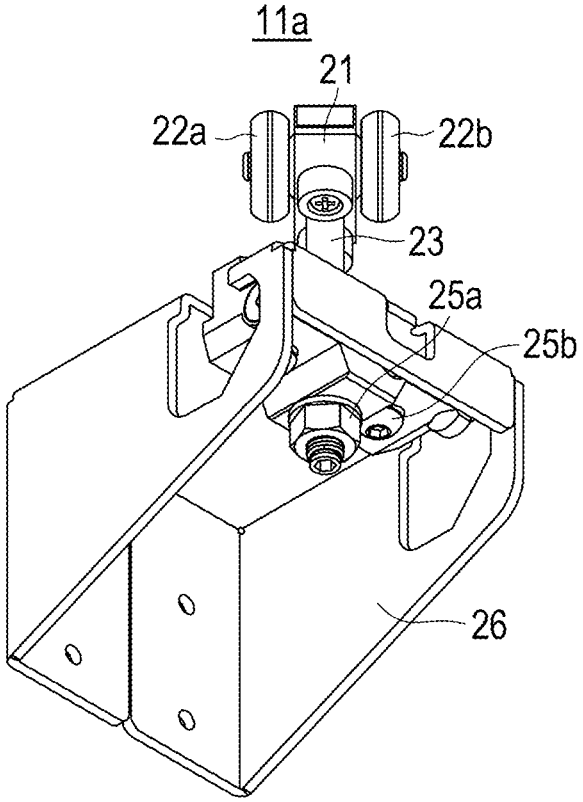
FIGS. 3A-3B are views showing a door roller for door tip of the sliding door device of the present embodiment
Figure 3B:
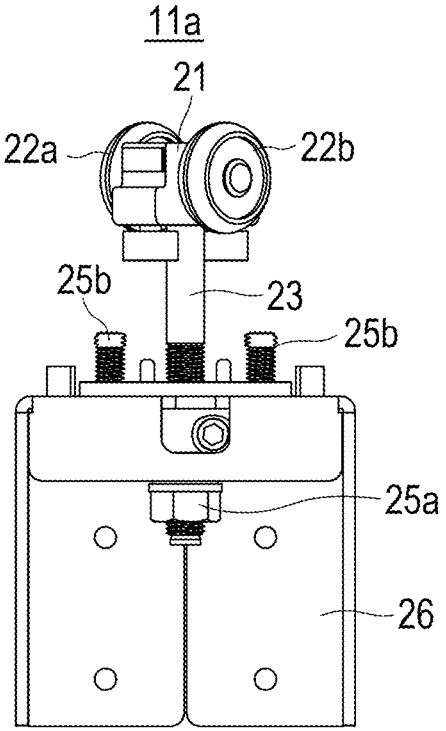

FIGS. 3A-3B show the door roller for door tip 11*a*. FIG. 3A shows the perspective view when the door roller for door tip 11*a* is seen from the lower side, and FIG. 3B shows the side view of the door roller for door tip 11*a*. The door roller for door tip 11*a* is provided with a door roller main body 21 and a pair of left and right rollers 22*a* and 22*b* rotatably attached to left and right side-surfaces of the door roller main body 21. The door roller main body 21 is provided with a hanging bolt 23 projecting downward. The hanging bolt 23 projects downward from a opening 24 (see FIG. 1) of the door tip rail 7*a*. A bracket 26 is attached to the hanging bolt 23 by fastening members 25*a* and 25*b*. The bracket 26 is attached to a back surface of the sliding door 2.

Since the door roller for door tail 11*b* has substantially the same configuration as the door roller for door tip 11*a*, the same reference numeral is assigned and the description thereof will be omitted. As shown in FIG. 2, a bracket 27 is attached to the hanging bolt 23 of the door roller for door tail 11*b*. A projecting length of the bracket 27 from the sliding door 2 is shorter than a projecting length of the bracket 26 from the sliding door 2. This is because the door tail rail 7*b* is disposed closer to the sliding door 2 than the door tip rail 7*a*. Since the configurations of the door roller for door tip 11*a* and the door roller for door tail 11*b* are known, the further detailed descriptions thereof will be omitted.

Figure 4A:
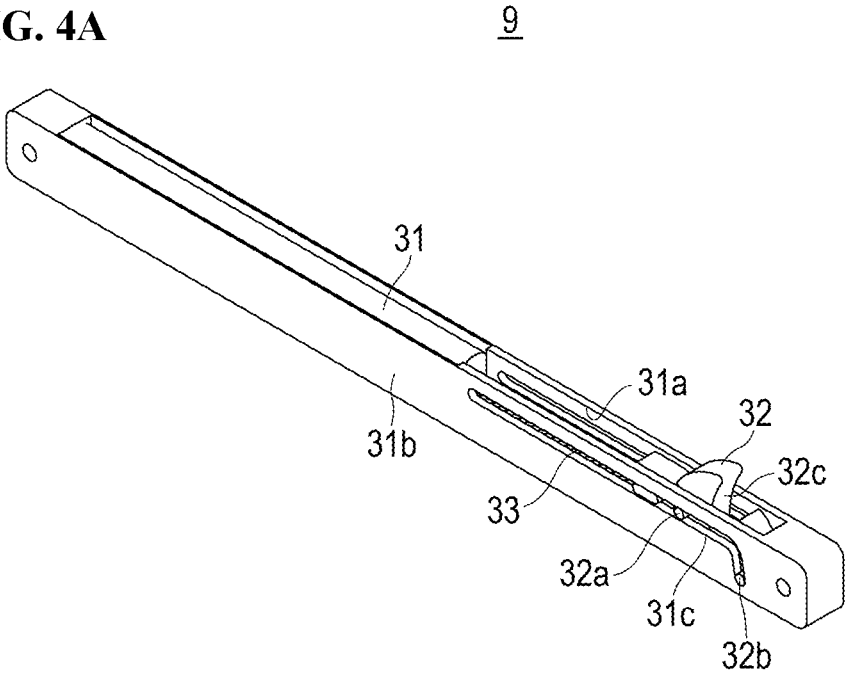
FIGS. 4A-4B are perspective views of a retracting device of the sliding door device of the present embodiment
Figure 4B:
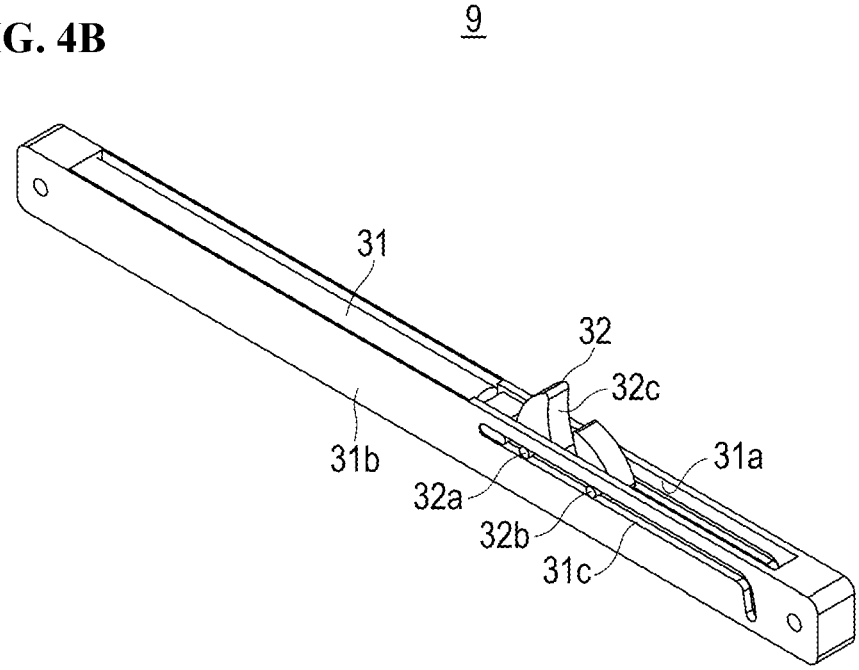
Figure 5A:
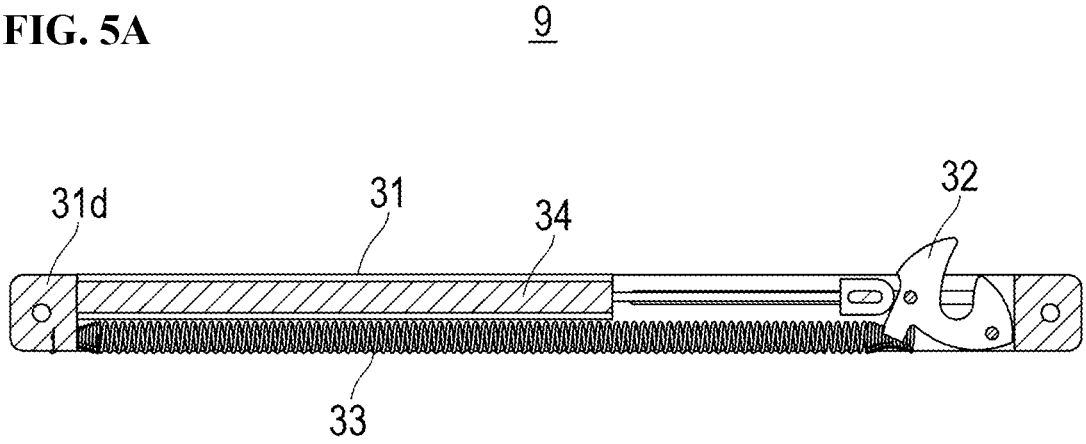
FIGS. 5A-5B are cross-section views of the retracting device of the sliding door device of the present embodiment (FIG. 5A) shows when the catcher is in the standby position and FIG. 5B shows when the catcher is in the retracted position).
Figure 5B:
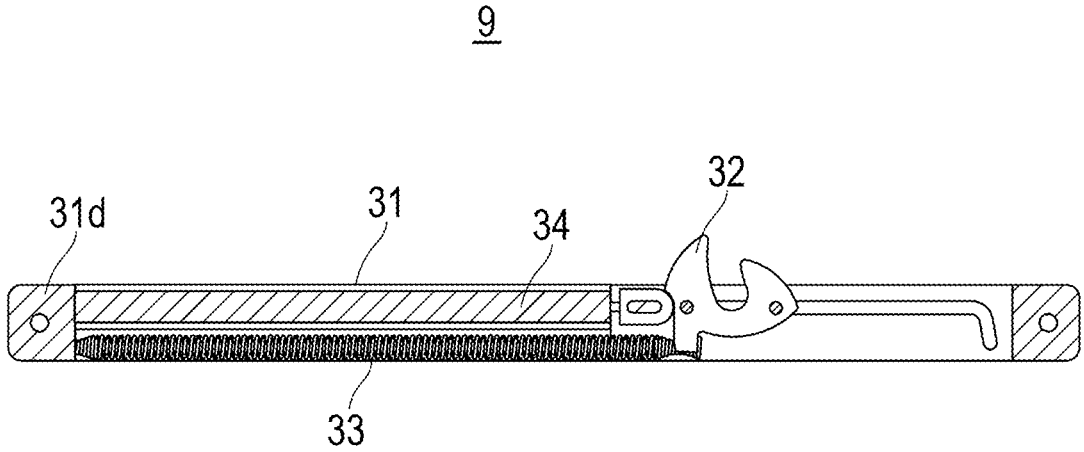

FIGS. 4A-4B show the perspective views of the retracting device 9, and FIG. 5 shows the cross-section views of the retracting device 9. FIG. 4A and FIG. 5A show a standby position of a catcher 32 of the retracting device 9, and FIG. 4B and FIG. 5B show a retracted position of the catcher 32. The retracting device 9 includes a case 31, the catcher 32 slidably provided in the case 31, and a spring 33 for pulling the catcher 32 (see FIGS. 5A-5B).

As shown in FIGS. 4A-4B, the case 31 is a flat rectangular parallelepiped and extends in the retracting direction. An opening 31*a* for exposing the catcher 32 is formed on an upper surface of the case 31. In each of a pair of side walls 31*b* of the case 31, formed is a groove 31*c* which linearly extends in a longitudinal direction of the case 31 and of which distal end is curved downward. As shown in FIG. 2, the retracting device 9 is attached to the sliding door 2 via a bracket 30.

The catcher 32 is sandwiched between the pair of side walls 31*b* of the case 31 and slides between the side walls 31*b*. On each of a pair of side surfaces of the catcher 32, two protrusions 32*a* and 32*b* engaged in the groove 31*c* are formed. The slide of the catcher 32 is guided by the groove 31*c*. Further, the orientation of the catcher 32 is controlled by the groove 31*c*. A U-shaped capture 32c for capturing the trigger 8 is formed in the catcher 32.

As shown in FIG. 5, the spring 33 is interposed between an end 31*d* of the case 31 and the catcher 32. The spring 33 pulls the catcher 32. A linear damper 34 is interposed between the end 31*d* of the case 31 and the catcher 32. The linear damper 34 puts a brake on the catcher 32 pulled by the spring 33.

As shown in FIG. 4A, when the catcher 32 in the standby position captures the trigger 8, as shown in FIG. 4B, the catcher 32 rotates and the protrusion 32*b* of the catcher 32 comes out of the curved portion of the groove 31*c* and the catcher 32 is pulled by the force of the spring 33. In this embodiment, since the trigger 8 is attached to the main body 3, the case 31 of the retracting device 9 moves in the retracting direction A (see FIG. 1) and the sliding door 2 is retracted in the retracting direction A. Since the configuration of the retracting device 9 is known, the further detailed description thereof will be omitted.

The retracting device 9 of FIGS. 4A-4B is a retracting device 9 for closing which retracts the sliding door 2 only to the closed position. However, as shown in FIG. 2, the retracting device 9' for opening and closing which retracts the sliding door 2 in both the closed position and the open position can be used as the retracting device 9'. In this case, as shown in FIG. 2, the case 31 is provided with two catchers 32 and 36, that is, the catcher 32 for closing and the catcher 36 for opening, and the case 31 is provided with two springs for pulling the two catchers 32 and 36. By attaching a trigger 37 (see FIG. 2) to engage with the catcher 36 for opening onto the main body 3 side, the sliding door 2 can be retracted into the open position. The configuration of this retracting device 9' for opening and closing is also known, and thus the detailed description will be omitted.

Figure 6A:
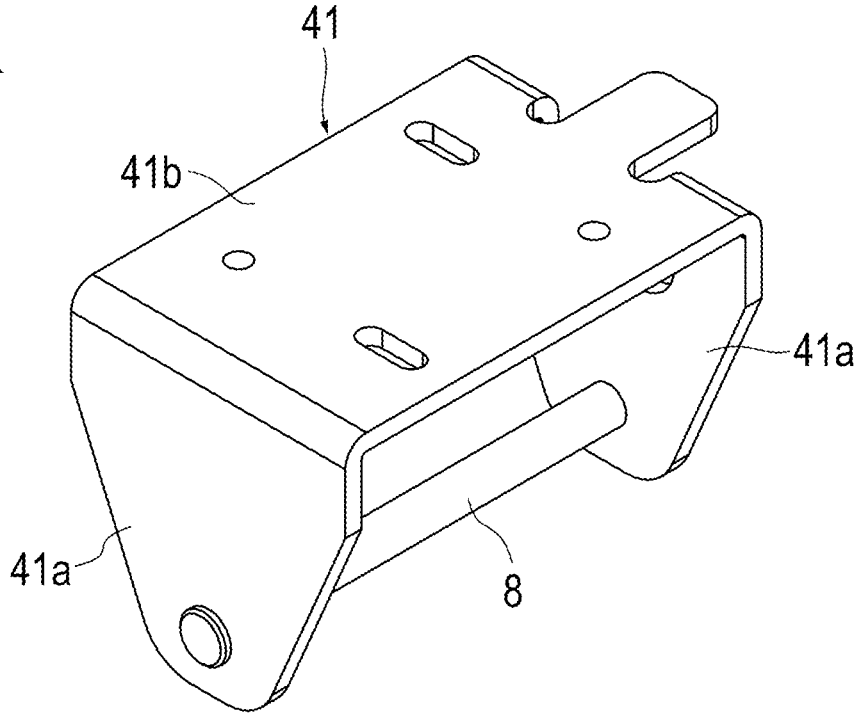
FIGS. 6A-6B are detailed views of a trigger of the sliding door device of the present embodiment
Figure 6B:
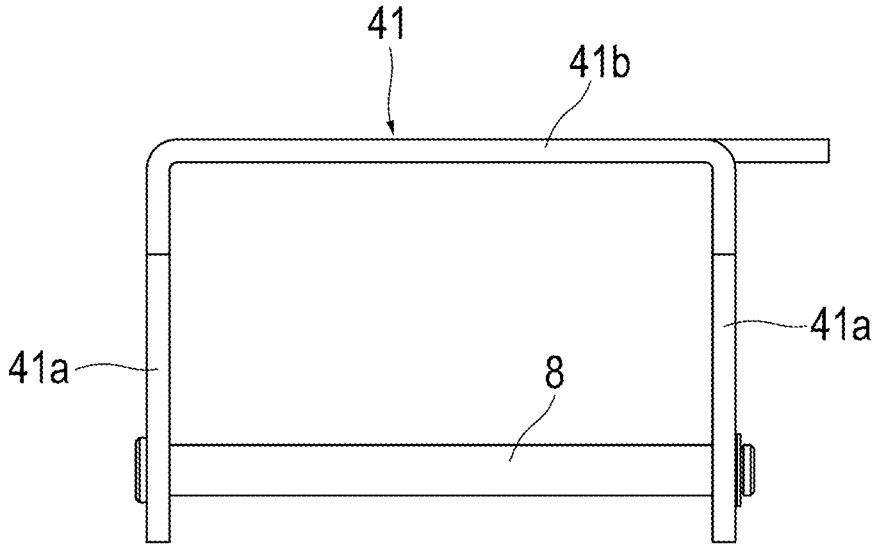

FIGS. 6A-6B are the detailed views of the trigger 8. FIG. 6A is the perspective view of the trigger 8 as viewed from the upper side and FIG. 6B is the side view of the trigger 8. The trigger 8 is in the form of an axis. Both ends of the trigger 8 in an axial direction are supported by the bracket 41. The bracket 41 is U-shaped, and includes a substrate portion 41*b* attached to the upper frame 4 and a pair of side plate portions 41*a* which are bent at both ends of the substrate portion 41*b* and face to each other. The both ends of the trigger 8 are supported by the pair of side plate portions 41*a*. As shown in FIG. 1, in a state that the bracket 41 is attached to the main body 3, the trigger 8 extends in a horizontal direction and at a right angle with respect to the retracting direction A. By supporting the both ends of the trigger 8 by the brackets 41, it is possible to stably support the trigger 8 extending in the horizontal direction.

Figure 7A:
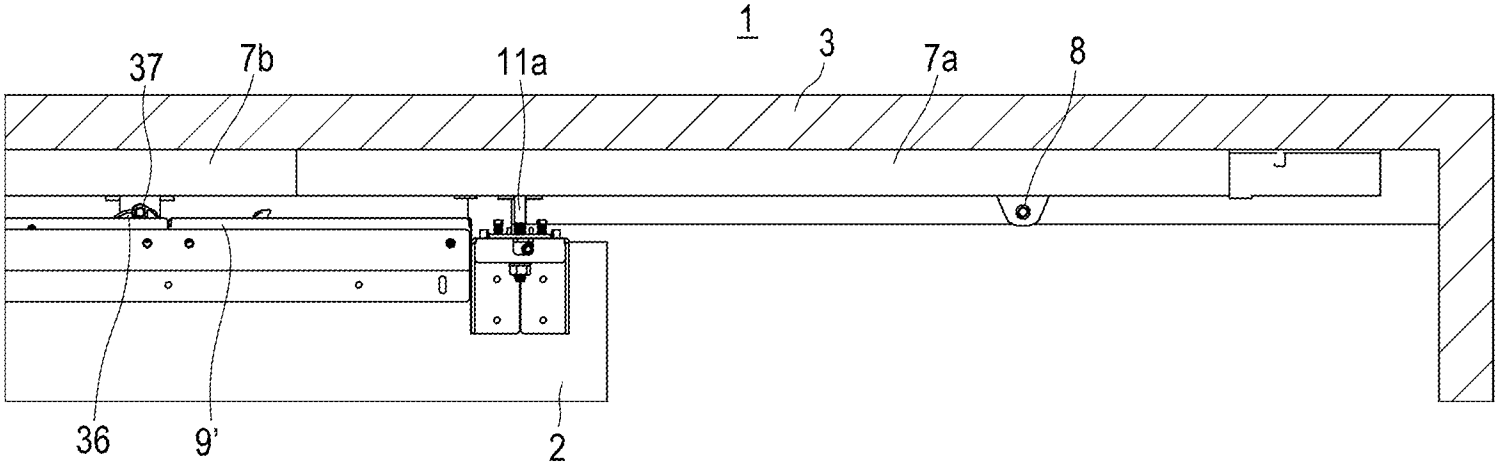
FIGS. 7A-7B are views showing the sliding door device when the sliding door is in the open position
Figure 7B:
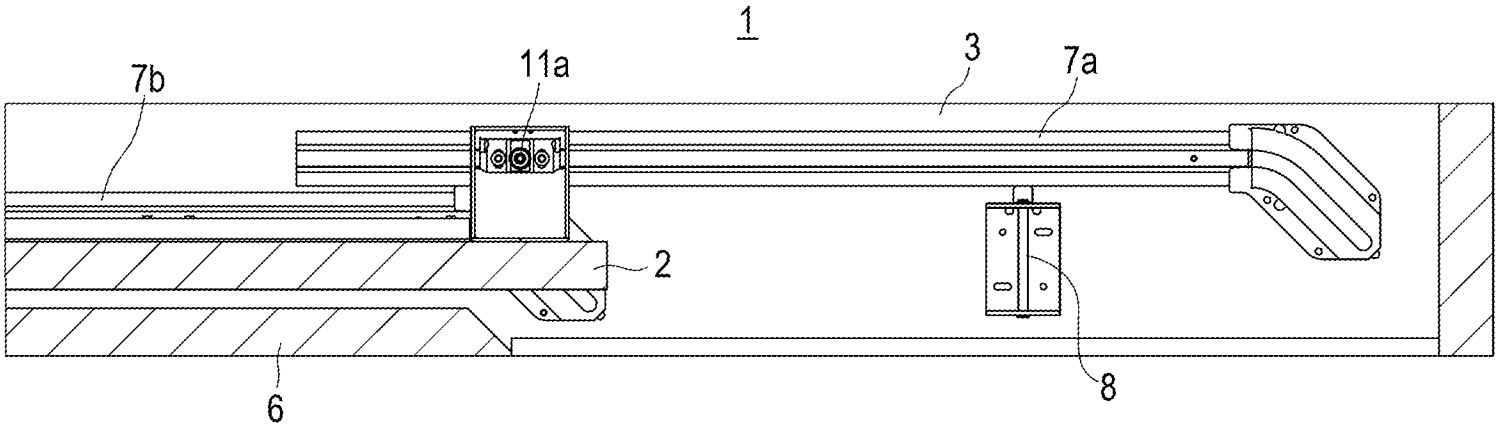
Figure 8A:
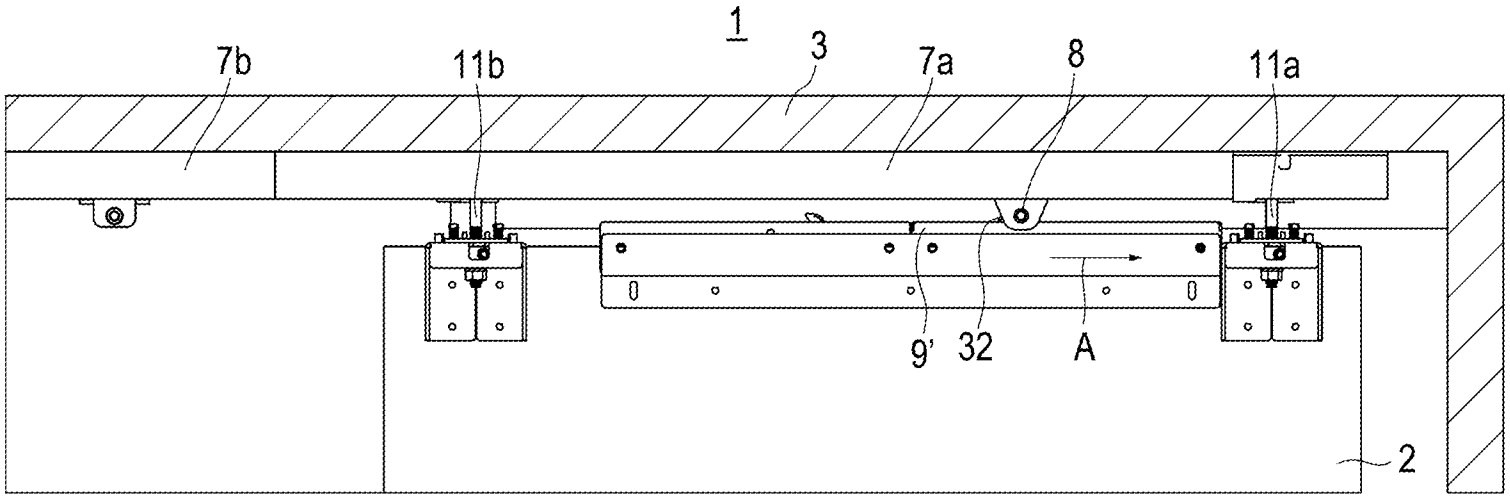
FIGS. 8A-8B are views showing the sliding door device when the sliding door is in a retraction start position
Figure 8B:
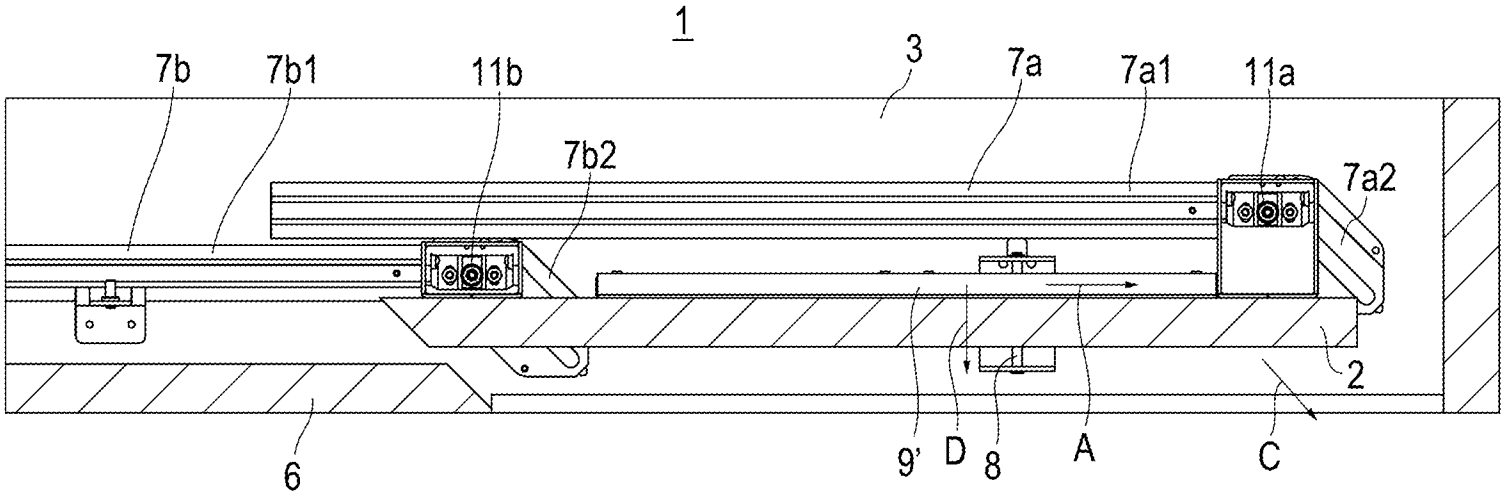
Figure 9A:
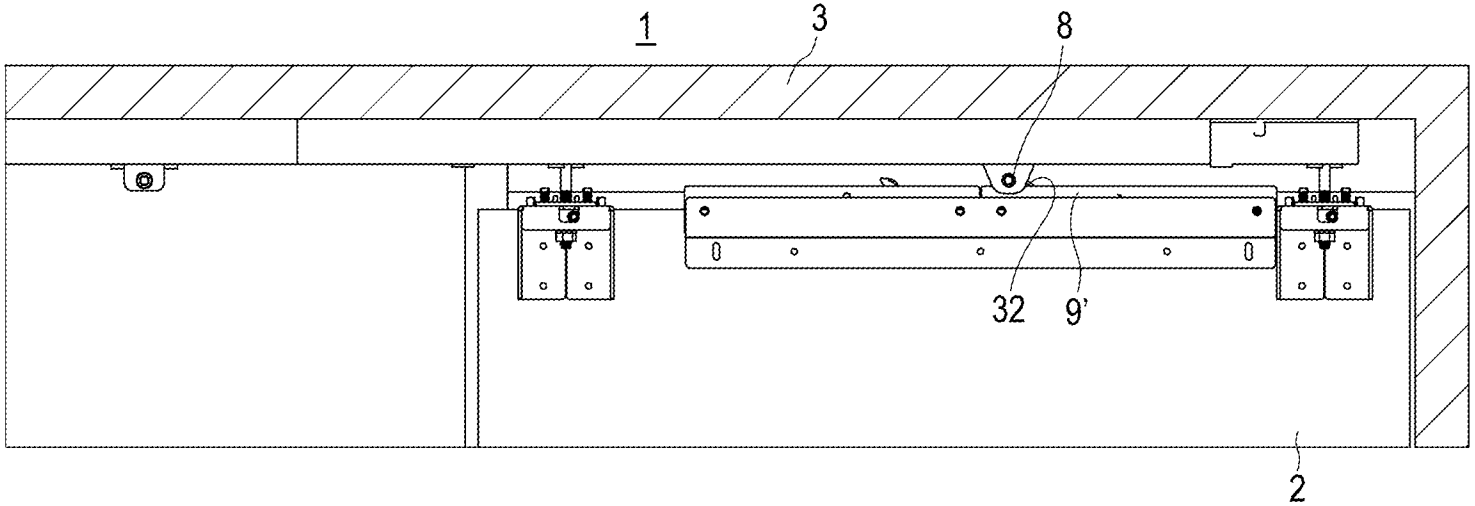
FIGS. 9A-9B are views showing the sliding door device when the sliding door is in the closed position
Figure 9B:
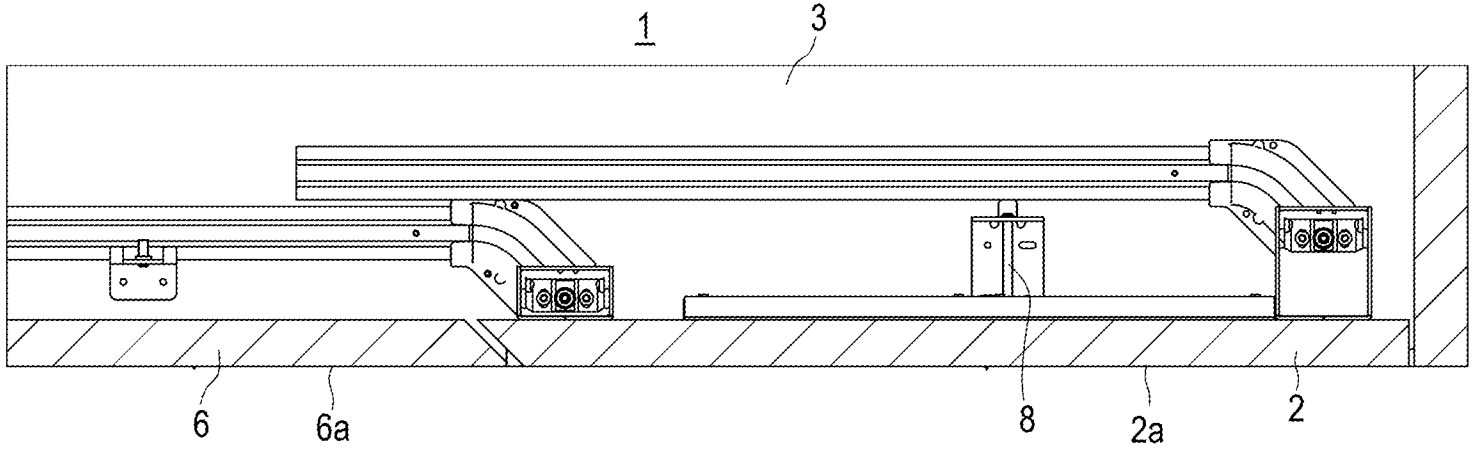

FIGS. 7A-7B show the sliding door device 1 when the sliding door 2 is in the open position. FIGS. 8A-8B show the sliding door device 1 when the sliding door 2 is in the retraction start position. FIGS. 9A-9B show the sliding door device 1 when the sliding door 2 is in the closed position. FIG. 7A to FIG. 9A show back views of the sliding door device 1 and FIG. 7B to FIG. 9B shows bottom views of the sliding door device 1.

As shown in FIGS. 7A-7B, when the sliding door 2 is in the open position, the catcher 36 for opening of the retracting device 9' captures the trigger 37. Therefore, a biasing force is exerted on the sliding door 2 in an opening direction by the retracting device 9', so that the sliding door 2 is kept in the open position.

As shown in FIGS. 8A-8B, when users move the sliding door 2 from the open position in the retracting direction, the engagement between the catcher 36 for opening and the trigger 37 is released, and the catcher 32 for closing engages with the trigger 8. The position of the sliding door 2 shown in FIGS. 8A-8B is a retraction start position of the sliding door 2. At the retraction start position, the door roller door tip 11*a* is located on the straight rail 7*a*1 of the door tip rail 7*a*, and the door roller door tail 11*b* is located on the straight rail 7*b*1 of the door tail rail 7*b*.

When the retracting device 9' retracts the trigger 8, the case 31 and the sliding door 2 of the retracting device 9' move linearly in the retracting direction A indicated by the arrows. When the sliding door 2 moves in the retracting direction A by the retracting device 9', the sliding door 2 starts to move obliquely along the inclined rails 7*a*2 and 7*b*2.

When the sliding door 2 moves obliquely, the retracting device 9' retracts the trigger 8 while sliding in an axial direction D. This makes it possible to allow the sliding door 2 to move obliquely (oblique direction C) along the inclined rails 7*a*2 and 7*b*2. At this time, the catcher 32 of the retracting device 9' slides in the axial direction D of the trigger 8 with capturing the trigger 8. The case 31 of the retracting device 9' (see FIGS. 4A-4B) moves obliquely (oblique direction C) along the inclined rails 7*a*2 and 7*b*2 together with the sliding door 2.

A translation start position at which the sliding door 2 starts to move obliquely is closer to the closed position than the retraction start position. As a result, while the sliding door 2 linearly moves in the retracting direction A, it is possible to exert the retraction force, so that the users can easily close the sliding door 2. In this regard, it is also possible to arrange the translation start position closer to the open position than the retraction start position.

As shown in FIGS. 9A-9B, the retraction of the sliding door 2 by the retracting device 9' continues until the sliding door 2 moves to the closed position. A length of the trigger 8 in the axial direction is longer than a distance of forward movement of the sliding door 2 so as to allow the sliding door 2 to move forward. In the closed position of the sliding door 2, the biasing force in the oblique direction is exerted on the sliding door 2 by the retracting device 9', and the closed position of the sliding door 2 is maintained. In the closed position of the sliding door 2, a surface 2*a* on the front side of the sliding door 2 and a surface 6*a* of the wall 6 of the main body 3 become flat.

SECOND EMBODIMENT

Figure 10:
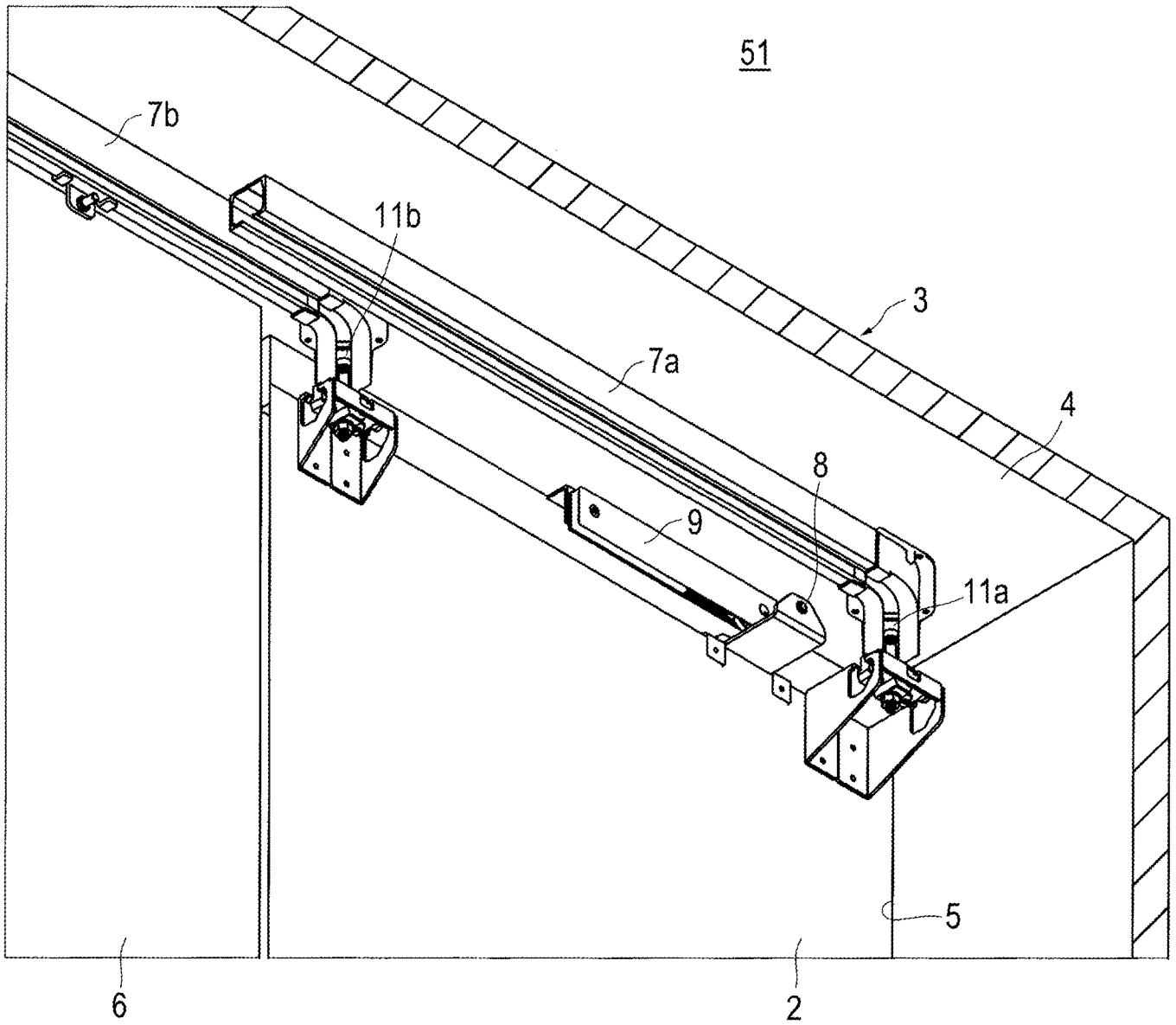
FIG. 10 is a perspective view of a sliding door device (when a sliding door is in a closed position) of a second embodiment of the present invention as viewed from a lower side.
Figure 11A:
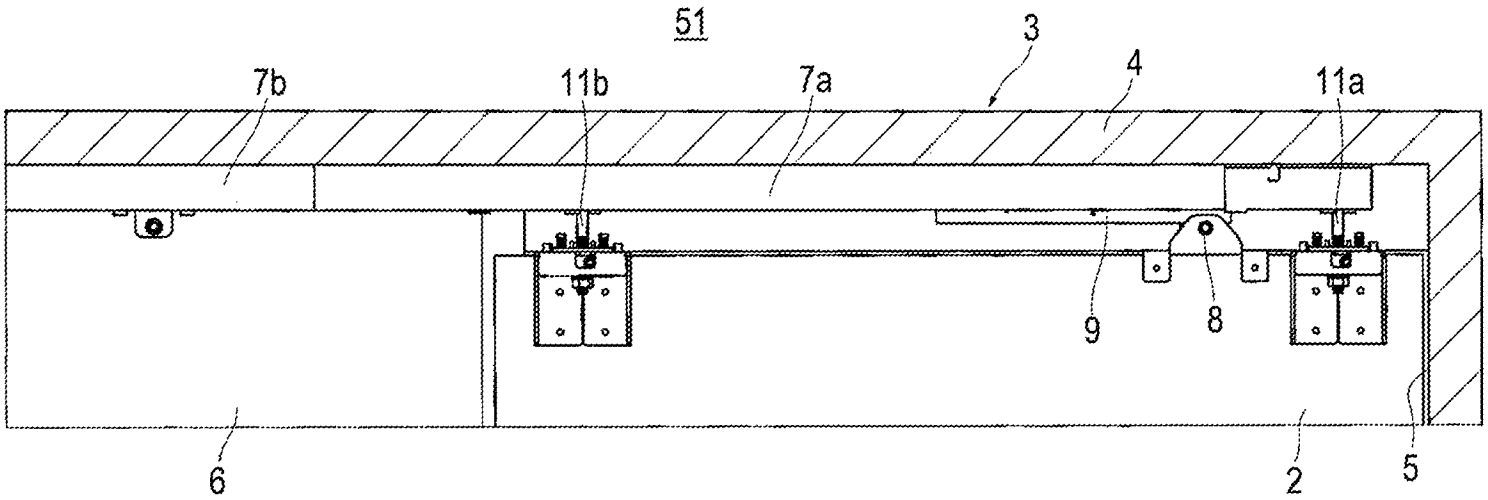
FIGS. 11A-11B are views showing the sliding door device of the second embodiment of the present invention
Figure 11B:
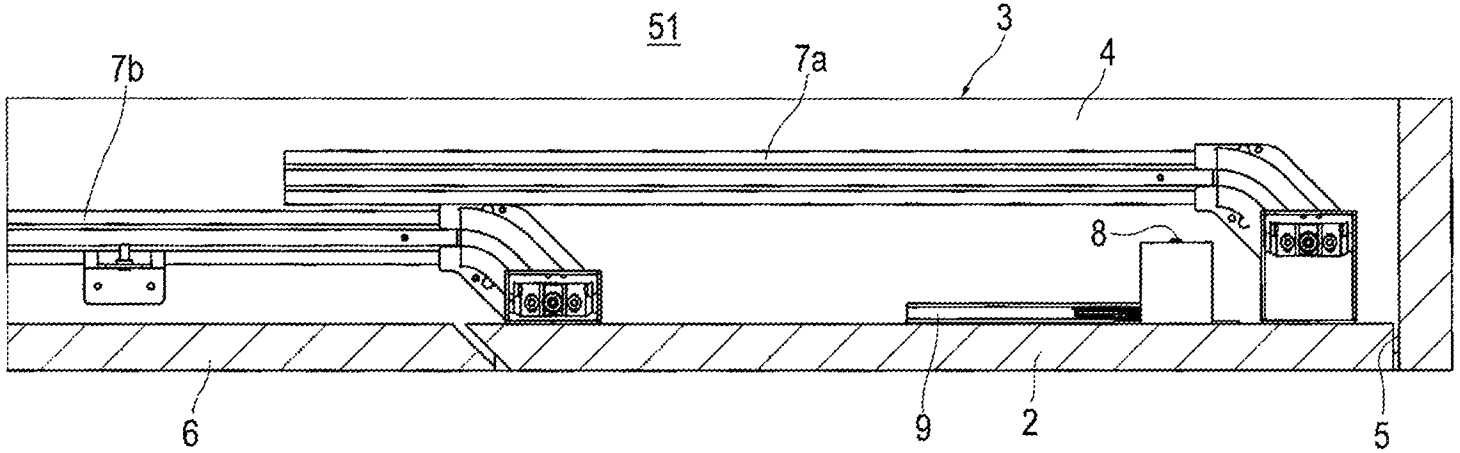

FIG. 10 shows a perspective view of a sliding door device 51 of a second embodiment of the present invention as viewed from a lower side. FIG. 11A shows a side view of the sliding door device 51 of the second embodiment and FIG. 11B shows a bottom view. In these drawings, the sliding door 2 is in the closed position. 2 is the sliding door, 3 is a main body, 4 is an upper frame of the main body, 5 is an opening of the main body, and 6 is a wall of the main body.

The sliding door device 51 of the second embodiment also includes rails 7*a* and 7*b*, a trigger 8 and a retracting device 9. Since the configurations of the rails 7*a* and 7*b*, the door roller for door tip 11*a*, and the door roller for door tail 11*b* are the same as those of the first embodiment, the same reference numerals are assigned and the descriptions thereof will be omitted. Further, since the configuration of the trigger 8 itself is substantially the same as that of the first embodiment, the same reference numeral is assigned and the description thereof will be omitted. The retracting device 9 for closing shown in FIGS. 4A-4B is used for the retracting device.

The second embodiment is different from the first embodiment in that the trigger 8 is attached to the sliding door 2 and the retracting device 9 is attached to the main body 3. Even if the trigger 8 is attached to the sliding door 2 and the retracting device 9 is attached to the main body 3, the retracting device 9 can retract the rod-shaped trigger 8 while sliding in the axial direction of the rod-shaped trigger 8. For this reason, it is possible to retract the sliding door 2 diagonally.

The present invention is not limited to one embodied in the above-described embodiments and can be changed to various embodiments without departing from the scope of the present invention.

In the above embodiment, the sliding door moves forward in the front view of the sliding door to make the sliding door and the wall surface flat. However, it is also possible to move the sliding door backward in the front view of the sliding door to make the sliding door and the wall surface flat.

Moreover, in the above embodiments, although the sliding door and the wall surface are made flat in the closed position of the sliding door, the sliding door and the wall surface may not be made flat in the closed position of the sliding door. For example, in order to improve the airtightness of the opening, the sliding door can move forward in the front view, and the sliding door can be closely attached to a packing provided in a frame of the opening.

In the above embodiments, although the sliding door and the wall surface are made flat in the closed position of the sliding door, the sliding door and the adjacent sliding door may be made flat in the closed position of the sliding door.

The configuration of the retracting device of the above-described embodiments is an example and other configurations can be adopted without departing from the scope of the present invention, such as omitting the damper.

EXPLANATION OF REFERENCE NUMERAL

1, 51 Sliding door device
2 Sliding door
3 Main body
7*a* Door tip rail (rail)
7*b* Door tail rail (rail)
8 Trigger
9, 9' Retracting device
41 Bracket
A Retracting direction
B Forward
C Oblique direction
D Axial direction

What is claimed is:

1. A sliding door device comprising:

rails for guiding a sliding door to move in a retracting direction along a length of the rail from an open position to a closed position with respect to a main body, and guiding the sliding door to move in a direction orthogonal to a surface of the sliding door along a width of the rail until reaching the closed position;

a rod-shaped trigger arranged outside the rails and provided on the main body; and a retracting device provided on the sliding door, and retracting the trigger while sliding in its longitudinal direction of the rod-shaped trigger so that the sliding door can move forward or backward along the width of the rail;

wherein the rails attached to an upper frame of the main body, and comprising a door trip rail composed of a straight rail and an inclined rail and a door tail rail composed of a straight rail and an inclined rail, and the trigger attached to an area of the upper frame of the main body divided by the straight rail of the door trip rail in an inclined direction of the inclined rail.

2. The sliding door device as claimed in claim 1, wherein both ends of the trigger in the axial direction are supported by a bracket attached to the one of the main body and the sliding door.

3. The sliding door device as claimed in claim 1, wherein a translation start position where the sliding door starts to move forward or backward is closer to the closed position than a retraction start position where the retracting device engages with the trigger to start the retraction.

4. The sliding door device as claimed in claim 2, wherein a translation start position where the sliding door starts to move forward or backward is closer to the closed position than a retraction start position where the retracting device engages with the trigger to start the retraction.

* * * * *